US005950825A

United States Patent [19]

Shin

[11] Patent Number: 5,950,825

[45] Date of Patent: Sep. 14, 1999

[54] GOLF BAG FOR PROTECTING GOLF CLUB SHAFTS

[76] Inventor: Byung Shin, 2500 White Rd., Irvine, Calif. 92714

[21] Appl. No.: 08/779,137

[22] Filed: Jan. 6, 1997

[51] Int. Cl.[6] ..... A63B 55/00

[52] U.S. Cl. ..... 206/315.6; 206/315.3

[58] Field of Search ..... 206/315.3, 315.5, 206/315.6

[56] References Cited

U.S. PATENT DOCUMENTS

| | | | |
|---|---|---|---|
| 936,698 | 10/1909 | Breakspear | 206/315.6 |
| 1,840,183 | 1/1932 | Blitch | 206/315.6 |
| 2,751,955 | 6/1956 | Nahon | 206/315.6 |
| 2,879,819 | 3/1959 | Turnbull | 150/160 X |
| 3,331,419 | 7/1967 | Bencriscutto | 206/315.6 |
| 3,554,255 | 1/1971 | Mangan | 206/315.6 |
| 3,674,072 | 7/1972 | Shuto | 206/315.6 |
| 3,941,398 | 3/1976 | Nelson | 206/315.6 X |
| 3,980,115 | 9/1976 | Longo | 206/315.6 |
| 4,055,207 | 10/1977 | Goodwin | 206/315.6 |
| 4,182,391 | 1/1980 | Kjose | 206/315.5 |
| 4,194,547 | 3/1980 | Sidor et al. | 206/315.6 |
| 4,241,774 | 12/1980 | Pell | 206/315.6 |
| 4,332,283 | 6/1982 | Rader | 206/315.6 |
| 4,383,563 | 5/1983 | Kirchhoff, Jr. | 206/315.5 X |
| 4,911,292 | 3/1990 | Airey, Jr. | 206/315.3 |
| 4,944,396 | 7/1990 | Larkin | 206/315.6 |
| 4,988,216 | 1/1991 | Lyman | 383/74 |
| 5,096,059 | 3/1992 | Henderson | 206/315.5 |
| 5,099,898 | 3/1992 | Miller | 150/160 |
| 5,135,107 | 8/1992 | Ingraham | 206/315.6 |
| 5,148,915 | 9/1992 | Ryan | 206/315.3 X |
| 5,190,376 | 3/1993 | Book | 383/4 |
| 5,222,598 | 6/1993 | Yamazoe | 206/315.5 |
| 5,226,533 | 7/1993 | Antonious | 206/315.6 |
| 5,228,566 | 7/1993 | Shenoha | 206/315.6 |
| 5,431,278 | 7/1995 | Gretz | 206/315.6 |
| 5,447,228 | 9/1995 | Hodgson, III | 206/315.3 |
| 5,450,958 | 9/1995 | Shin | 206/315.6 |
| 5,458,240 | 10/1995 | Rich | 206/315.6 X |
| 5,505,300 | 4/1996 | Joh | 206/315.6 |
| 5,573,112 | 11/1996 | Kim | 206/315.6 |
| 5,624,028 | 4/1997 | Shin et al. | 206/315.3 X |
| 5,645,166 | 7/1997 | Su | 206/315.6 |

FOREIGN PATENT DOCUMENTS

| | | | |
|---|---|---|---|
| 2048177 | 1/1983 | Canada . | |
| 2 130 102 | 5/1984 | United Kingdom | 206/315.6 |

*Primary Examiner*—Sue A. Weaver

*Attorney, Agent, or Firm*—John J. Connors; Connors & Assoc.

[57] ABSTRACT

A golf bag includes a bag body having a substantially cylindrical configuration with a closed end, an open end, and a sidewall between said ends forming an internal cavity which receives the shafts of golf clubs. A golf club receptacle structure at the open end has a lower portion with a circumferential section divided into a plurality of outer receptacle compartments, and, in outline, a substantially truncated, conical-like upper portion at least partially extending outward from the open end of the bag body. The conical upper portion has a raised, inner, central section with a divider member that segregates the inner central section into a plurality of inner receptacle compartments. A substantially cylindrical, hollow connector section fits snugly within the open end of the bag body, and includes a frame with radial arms. The receptacle structure and the connector section have approximately equal sized diameters, with the lower portion of the receptacle structure fitting snugly within the connector section and supported by the frame. A liner member extends from the frame lengthwise into the cavity, and it has a plurality of liner compartments aligned with the outer and inner receptacle compartments, so that upon placing the shaft of the club into a receptacle compartment and then into the cavity, the shaft is received into an aligned liner compartment.

13 Claims, 4 Drawing Sheets

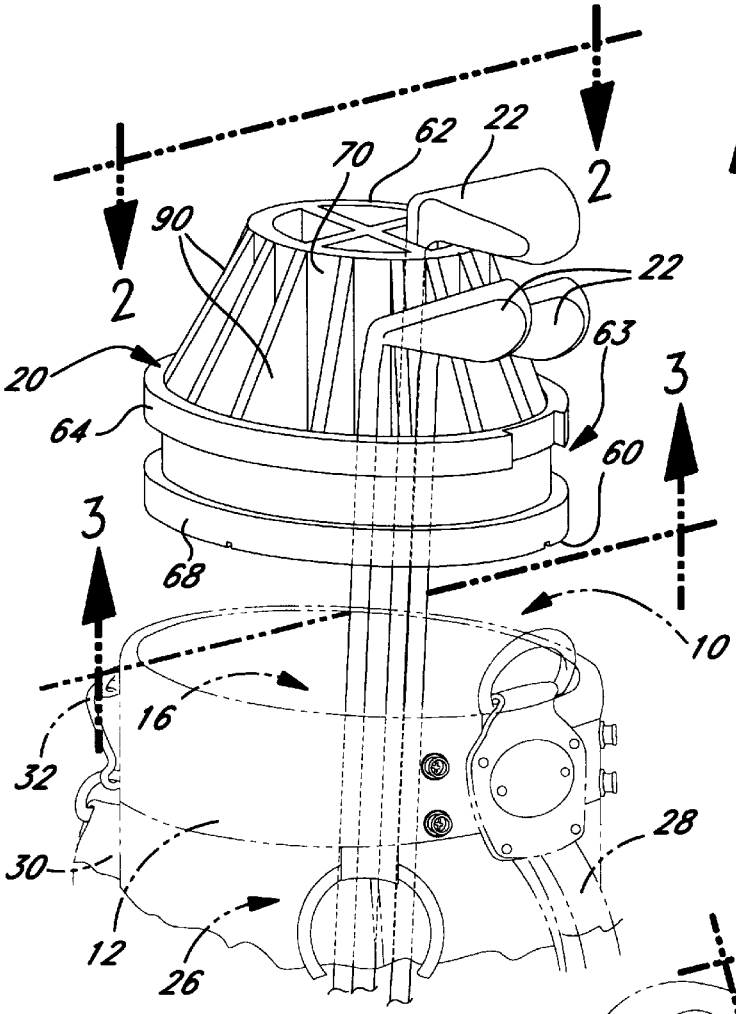
FIG. 1
FIG. 2
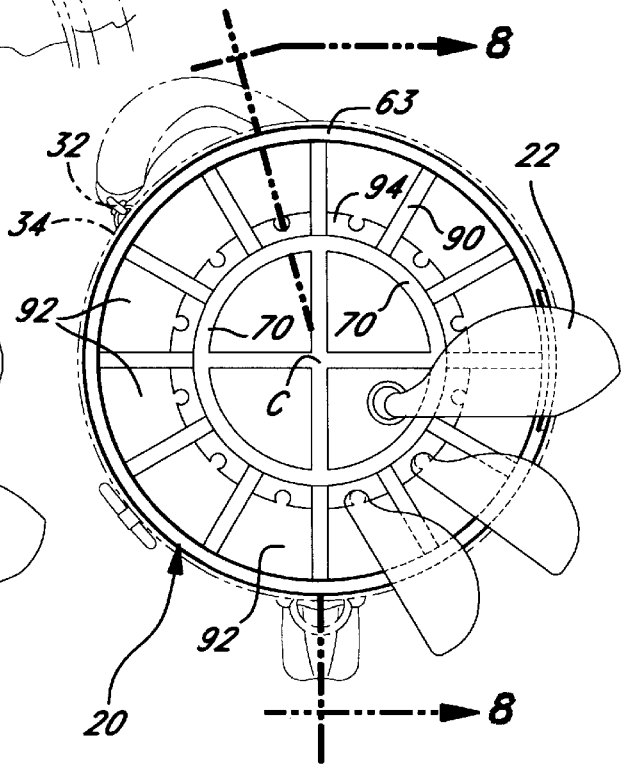
FIG. 3
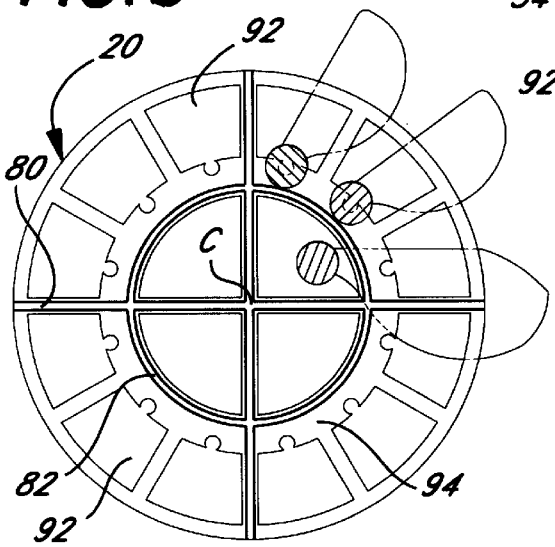

GOLF BAG FOR PROTECTING GOLF CLUB SHAFTS

BACKGROUND OF THE INVENTION

1. Field of the Invention

This invention relates to golf bags, and particularly to a golf bag which is constructed to prevent damage to shafts of golf clubs.

2. Background Discussion

Golf bags come in a wide variety of configurations, and some of them include divider elements which segregate the interior cavity of the golf bag into sections for holding individual golf clubs. Many of these golf bags are of extremely complex configurations, and they fail to protect adequately the shafts of golf clubs. This is particularly important in connection with graphite shafts which are easily damaged. In copending U.S. patent applications Ser. No. 08/526,816, filed Sep. 11, 1995, entitled Foam Organizer, now U.S. Pat. No. 5,624,028, and 08/412,702, filed Mar. 29, 1995, entitled Golf Bag With Foam Organizer, now U.S. Pat. No. 5,634,557, there are disclosed foam receptacles designed to prevent damage to golf club shafts.

SUMMARY OF THE INVENTION

It is the objective of this invention to improve the foam receptacle disclosed in the above-identified copending applications and make it more easily adapted to assemble with other important components of the golf bag for protecting the shafts of golf clubs.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include an easy to assembly receptacle structure and liner member which, in combination, prevent or minimize damage to the shafts of golf clubs, improved organization of clubs within the golf bag, and enhance convenience by providing easy access to the clubs.

The first feature of the golf bag of this invention is that it includes a bag body having a closed end, an open end, and a sidewall between the ends forming an internal cavity which receives the shafts of the golf clubs.

The second feature is a golf club receptacle structure at the open end. This receptacle structure has an internal end portion which is received within the open end, and, in outline, a substantially truncated, conical end portion at least partially extending outward from the open end. It is divided into a number of compartments to provide a plurality of openings which extend in a lengthwise direction through the receptacle structure. The internal end portion has a circumferential section divided into a plurality of outer receptacle compartments and the conical upper portion has a raised, inner, central section with a divider member that segregates the inner central section into a plurality of inner receptacle compartments. The circumferential section of the receptacle structure is spaced from, and connected to, the raised central section by a plurality of partition members which form between the perimeter of the circumferential section and the raised central section the outer receptacle compartments. Preferably, each compartment in the receptacle structure is sized to hold only one golf club.

The third feature is a gripper element in each of the outer receptacle compartments that grips a shaft of a golf club placed in an outer receptacle compartment. This maintains the shafts in a fixed position which is substantially parallel to the longitudinal axis of the bag body. The gripper holds the shaft in this position, so that it does not move within the compartment to strike a shaft of an adjacent golf club. Preferably, the receptacle structure is made of a foam, water proof polymeric material. For example, polyurethane having closed cells and a density of no more than 12 pounds per cubic feet.

The fourth feature is a frame within the cavity and connected to the bag body near the open end. This frame supports the receptacle structure. Preferably, the frame is part of a connector section. This connector section is hollow and it fits snugly within the open end of the bag body. The frame has a substantially cross-shape, and the receptacle structure has an underside including a cross-shaped channel. The cross-shaped frame is received within the cross-shaped channel upon placing the receptacle structure into the open end of the bag body. The frame has radial arms which extend from the center of the frame, and the center of the receptacle structure is coincident with the center of the frame upon assembling the connector section and receptacle structure. The raised central section preferably has a substantially cylindrical configuration with an underside including a substantially circular channel. The frame has a central circular section, which is received within the circular channel upon placing the receptacle structure into the open end of the bag body. The connector section and internal end portion of the receptacle structure each have a locking element which engage and interlock upon placing the receptacle structure into the open end of the bag body.

The fifth feature is a liner member which extends from the frame lengthwise downward into the cavity of the bag body. The upper portions of the fabric forming the liner member is wrapped around the frame and then sewn in position. The liner member has a plurality of liner compartments aligned with the openings in the receptacle structure, so that upon placing the shaft of the club into an opening and then into the cavity, the shaft is received in one of the liner compartments. This liner member has individual, inner, central liner compartments aligned with the individual, inner receptacle compartments, and each of these inner liner compartments is sized to hold only one golf club. Liner compartments around the periphery may hold several golf shafts, typically three, but the gripper elements hold those shafts in a common outer liner compartment apart from each other, so that the shafts do not strike each other when the bag is being transported.

The sixth feature is the geometrical configuration of the golf bag's components. Preferably, a bag body has a substantially cylindrical configuration and the connector section has a circular perimeter. The lower portion of the receptacle structure and open end of the bag have approximately the same length diameters, with the diameter of the open end being slightly longer, so that the receptacle structure fits snugly within the connector section. The frame has a cross shape with a circular portion encircling the center of the frame. The raised central section has a substantially cylindrical configuration and the divider member segregates it into approximately four equal sized, wedged-shaped compartments. The underside of the raised central section includes a cross-shaped channel and a substantially circular channel around the center of the cross-shape. Upon placing the receptacle structure into the open end of the bag body, the circular portion of the frame is received within the circular channel and the cross-shaped frame is received within the cross-shaped channel.

DESCRIPTION OF THE DRAWING

The preferred embodiment of this invention, illustrating all its features, will now be discussed in detail. This embodiment depicts the novel and non-obvious golf bag of this invention as shown in the accompanying drawing, which is for illustrative purposes only. This drawing includes the following figures (FIGS.), with like numerals indicating like parts:

FIG. 1 is a fragmentary, exploded perspective view showing the receptacle structure being inserted into the open end of the bag body of a golf bag.

FIG. 2 is a plan view taken along line 2—2 of FIG. 1.

FIG. 3 is a cross-sectional view of the underside of the receptacle structure taken along line 3—3 of FIG. 1.

DETAILED DESCRIPTION OF THE PREFERRED EMBODIMENT

Figure 4:
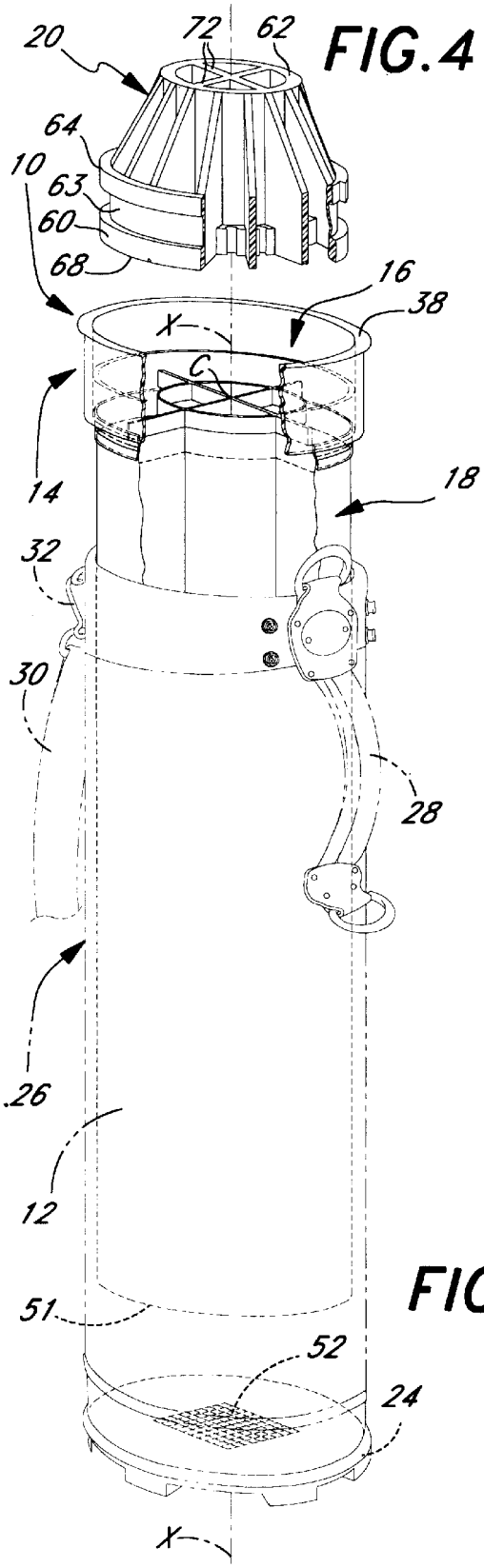
FIG. 4 is an exploded perspective view, with sections broken away, showing the receptacle structure, the connector section, and liner.

As best shown in FIGS. 1–4, the golf bag 10 of this invention includes a bag body 12, a connector section 14 (FIG. 4) near an open end 16 of the bag body 12, a liner 18 (FIG. 4) attached to the connector section 14, and a receptacle structure 20 extending out from the open end 16 and holding golf clubs 22. The bag body 12 has a substantially cylindrical configuration with a closed bottom end 24 (FIG. 4) and the open end 16, and a side wall 26 connecting the open end 16 and closed bottom end 24. The side wall 26 and closed end 24 form a cavity having an open mouth (the end 16) into which the golf clubs 22 are inserted with their shafts extending lengthwise in the cavity. A handle 28 is on one side of the bag body 12, and a strap 30 is on the other side of the bag body opposite the handle. The strap 30 has one end connected by a ring 32 to a loop element 34 (FIG. 2) riveted next to the open end 16.

Figure 7:
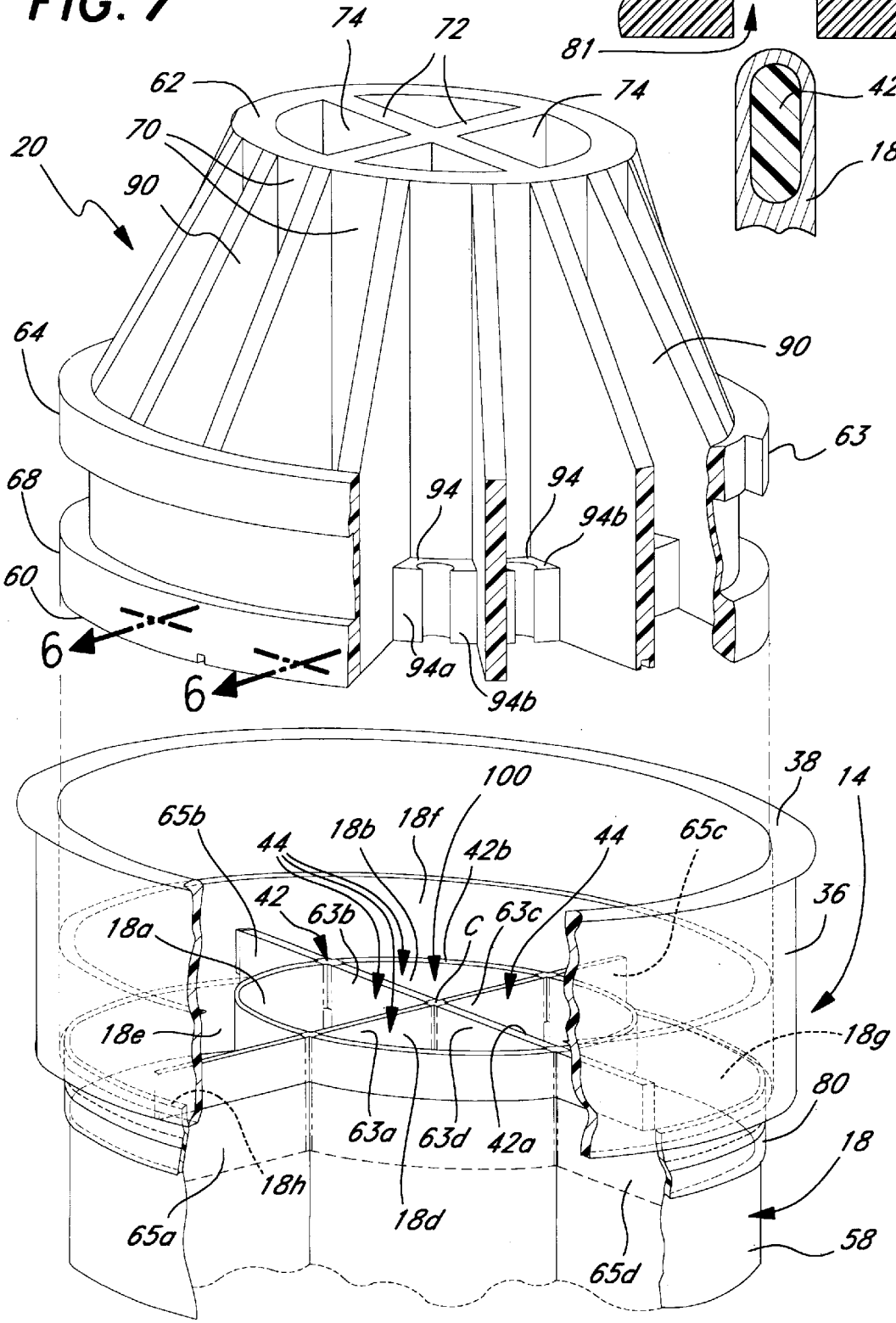
FIG. 7 is a fragmentary, exploded perspective view of the receptacle structure being inserted into the connector section.

As best shown in FIG. 7, the connector section 14 has a substantially hollow, cylindrical configuration with a side wall 36 having an upper rim 38 that engages the edge of the bag body 12 forming the open end 16 when the connector section is pushed into the open mouth of the cavity of the bag body 12. An internal lip 40 extends along the inside of the connector section 14 which serves as a locking element (to be explained in greater detail subsequently), which interlocks with the receptacle structure 20. There is a frame 42 that is integral with the inside surface of the side wall 36 of the connector section 14. This frame 42 has two main components that are integral with each other: a cross-shaped component 42*a* and a circular component 42*b*. The center C of the circular component 42*b* is coincident with the point where the arms of the cross component 42*a* intersect, and the central longitudinal axis X of the bag body 12. The circumference of the circular component 42*b* intersects with each arm of the cross component 42*a* about midway between the side wall 36 and the center C. There are four wedge shaped openings 44 formed by the intersection of the cross component 42*a* and circular component 42*b* of the frame 42. This integral frame 42 is displaced inward from the rim of the connector section 14. The lip 40 is spaced apart above and adjacent to the frame 42. As will become apparent from the subsequent description, this arrangement permits the receptacle structure 20 to be locked in a fixed position to the connector section 14 and supported by the frame 42.

Figure 5:
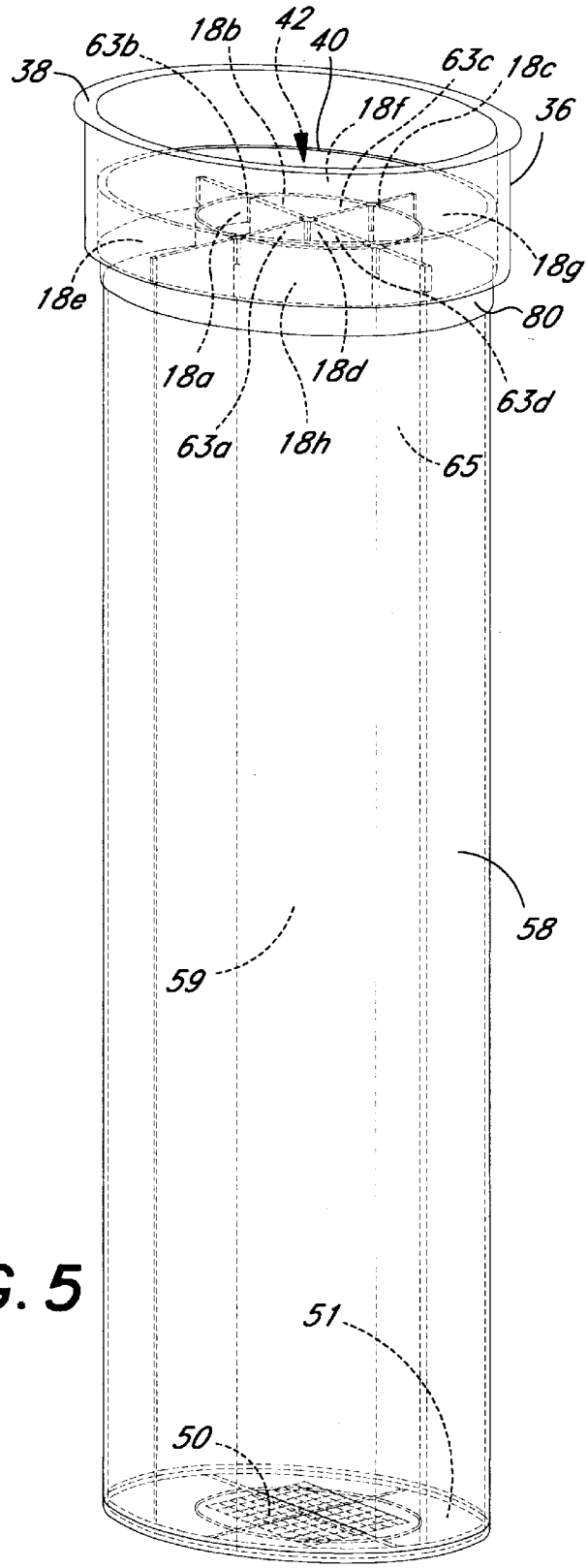
FIG. 5 is a perspective view of the assembled connector section and liner used in the golf bag of this invention.
Figure 6:
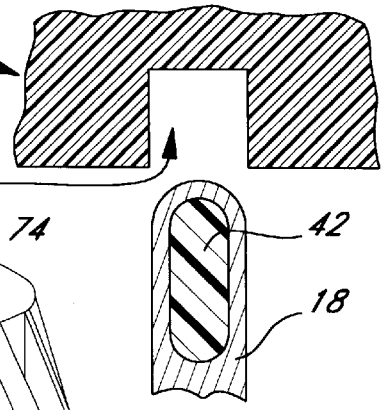
FIG. 6 is a cross-sectional view taken along line 6—6 of FIG. 7, with the receptacle structure separated from the connector section.

As best illustrate in FIG. 5, the liner 42 extends lengthwise from the frame 42, terminating near or at the closed bottom end 24 of the bag body 12. The liner 18 includes an outer wall section 58 and a concentric inner wall section 59 which are both of a generally cylindrical configuration. One component 50 (FIG. 5) of a hook and fabric fastener is attached to the exterior of a circular bottom fabric piece 51 sewn, or otherwise connected, to the lower ends of the wall sections 58 and 59. The other component 52 of the hook and fabric fastener is attached to the inside wall of the closed bottom end 24 of the bag body 12, so that when the liner 42 is inserted into the cavity of the bag body 12, the two components of the hook and fabric fastener interlock. Velcro Corporation makes a suitable hook and fabric fastener. The outer wall section 58 of fabric is sewn, or otherwise attached, to a circular band 80 which has a diameter slightly less than the inside diameter of the connector section 14. The band 80 is positioned to be concentric with the center C and is sewn, or otherwise connected, to the connector section 14. The inner wall section 59 hangs downward from the circular component 42*b* of the frame 42.

The liner 18 has four inner compartments 18*a*, 18*b*, 18*c*, and 18*d* and four outer compartments 18*e*, 18*f*, 18*g*, and 18*h*. The four inner compartments 18*a*, 18*b*, 18*c*, and 18*d* are formed by fabric creating divider walls 63*a*, 63*b*, 63*c*, and 63*d* which hang from the inner portions of the cross component 42*b* of the frame 18, extending throughout the length of the bag body 12, and terminating at or near the circular bottom fabric piece 51. Each divider wall 63*a*, 63*b*, 63*c*, and 63*d* has an upper section 100 (FIG. 8) which is wrapped around the inner portions of the cross component 42*b* of the frame 42, and then sewn in position along the dotted line 102. These four separate inner compartments 18*a*, 18*b*, 18*c*, and 18*d* are adapted to hold only one golf club.

In a similar fashion, the four outer compartments 18*e*, 18*f*, 18*g*, and 18*h* are formed by creating divider walls 65*a*, 65*b*, 65*c*, and 65*d* hanging from the outer portions of the cross component 42*b* of the frame 18, extending throughout the length of the bag body 12, and terminating at or near the circular bottom fabric piece 51. Each divider wall 65*a*, 65*b*, 65*c*, and 65*d* has an upper section 104 (FIG. 8) which is wrapped around the outer portions of the cross component 42*b* of the frame 42, and then sewn in position along the dotted line 102. Each of the four outer compartments 18*e*, 18*f*, 18*g*, and 18*h* are adapted to hold several golf clubs, typically three.

Figure 8:
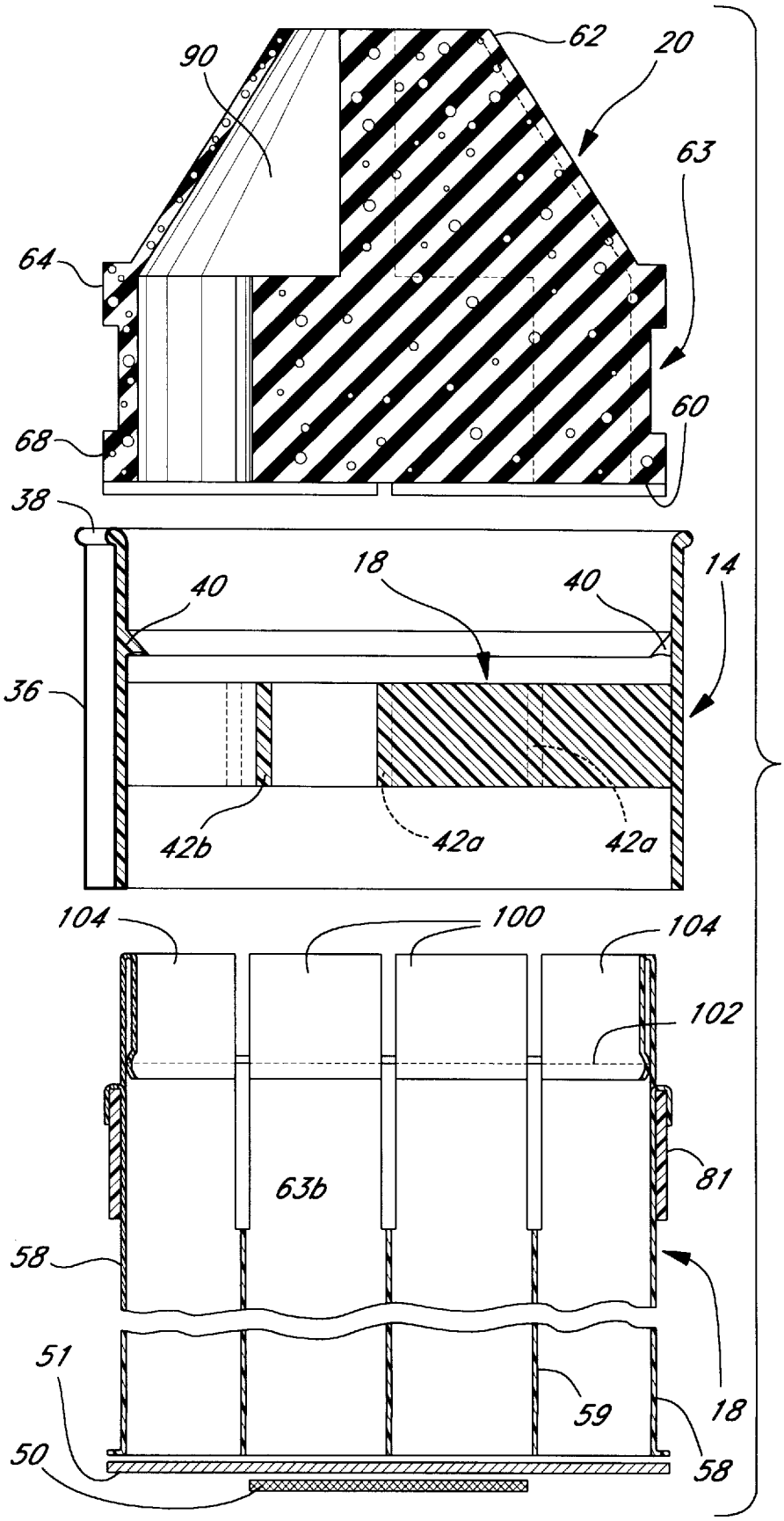
FIG. 8 a cross-sectional view taken along 8—8 of FIG. 2, showing the upper portion of the fabric forming the walls of the liner member folded as they would be when wrapped around the frame.

In FIG. 8, the upper portions 100 and 104, respectively, of the divider walls 63*a*, 63*b*, 63*c*, and 63*d* and the divider walls 65*a*, 65*b*, 65*c*, and 65*d* are shown folded over as they would be when wrapped around the inner and outer portions of the cross component 42*b*, but for clarity have been shown folded as they would be when wrapped around the frame 18. The edges of the divider walls 63*a*, 63*b*, 63*c*, 63*d*, 65*a*, 65*b*, 65*c*, and 65*d* are sewn to the outer and inner wall sections 58 and 59, and the walls 63*a*, 63*b*, 63*c*, 63*d* intersect at the center C and are sewn together. The bottom ends of the divider walls 63*a*, 63*b*, 63*c*, 63*d*, 65*a*, 65*b*, 65*c*, and 65*d* are sewn into position to the circular bottom fabric piece 51. The preferred fabric material used in the liner 18 is nylon.

The receptacle section 20 is similar to the receptacle structure disclosed in copending U.S. patent applications Ser. No. 08/526,816, filed Sep. 11, 1995, entitled Foam Organizer, now U.S. Pat. No. 5,624,028, and Ser. No. 08/412,702, filed Mar. 29, 1995, entitled Golf Bag With Foam Organizer, now U.S. Pat. No. 5,634,557. Both of these copending applications are incorporated herein by reference and made part of this application. The receptacle structure 20 is made from a polyurethane foam material with closed cells, rendering the foam material waterproof. The polyurethane foam preferably has a density of no more than 12 pounds per cubic feet. It has an internal end portion 60 and outer end portion 62 which projects from the open mouth of the cavity of the bag body 12.

In outline, the outer end portion 62 has a generally truncated, conical configuration. The internal end portion 60 of the receptacle structure 20 has a peripheral wall 63 with two exterior annular shoulders, an upper shoulder 64 and lower shoulder 68. The diameter of the internal end portion 60 of the receptacle structure 20 is approximately equal to the inside diameter of the connector section 14, so that this internal end portion 60 fits snugly within the connector section 14. The lower shoulder 68 will interlock with the lip 40 on the side wall of the connector section 14 upon inserting the internal end portion 60 of the receptacle structure 20 into the connector section and pushing the lower shoulder beneath the lip.

As best shown in FIG. 7, a cylindrical partition wall 70 forms a central raised, cylindrical section in the receptacle structure 20 which is segregated by internal planar partition walls 72 into four approximately equal-sized inner compartments 74, each sized to hold only a single club. These equal-sized compartments 74 are approximately the same size and shape as the four wedge shaped openings 44 formed by the intersection of the cross component 42*a* and circular component 42*b* of the frame 42. As shown in FIG. 3, the underside of the receptacle structure 20 has cross channels 80 aligned with the partition walls 72 and a circular channel 82 at the bottom of the cylindrical partition wall 70. These channels 80 and 82 intersect to form a channel configuration which has substantially the same configuration as the frame 42. Thus, when the receptacle structure 20 is pushed into the connector section 14 in the open end 16 of the bag body 12, after first aligning these channels with the cross frame component 42*a*, the frame will be received in the channels 80 and 82, when the lower shoulder 68 is beneath the lip 40. This brings the inner compartments 74 of the receptacle structure 20 into alignment with the inner compartments 18*a*, 18*b*, 18*c*, and 18*d* of the liner 18. Consequently, when a golf club 22 is placed in an inner compartment 74 of the receptacle structure 20, its shaft extends lengthwise downward into an aligned inner compartment of the liner 18.

Partition walls 90 extending between the peripheral wall 63 and the cylindrical wall 70 segregate the outer or circumferential portion of the receptacle structure 20 into separate, outer, circumferential compartments 92, each sized to hold only a single club. Each of these outer compartments 92 includes a gripper element 94 made of a polymeric material that does not damage graphite shafts. For example, a solid polyurethane material may be used to form the gripper elements 94 separately from the remaining body of the receptacle structure 20. Using conventional insert molding techniques, these gripper elements 94 are them placed into a mold for making the remaining body of the receptacle structure 20. Each gripper element 94 comprises a pair of fingers 94*a* and 94*b* that spread apart when a shaft of a golf club 22 is pushed between these fingers. These gripper elements 94 will hold the shaft firmly in position so that it does not move substantially, and therefore, will not strike an adjacent shaft extending into the same outer compartment 18*e*, 18*f*, 18*g*, or 18*h* of the liner 18.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A golf bag which holds golf clubs, each club having a shaft and a head, said golf bag including a bag body having a closed end, an open end, and a sidewall between said ends forming an internal cavity which receives the shafts of the golf clubs, a golf club receptacle structure made of a foam material and positioned at the open end, said receptacle structure having (i) an end portion which is received within the open end, and (ii) a plurality of openings which extend in a lengthwise direction through said receptacle structure, said receptacle structure having a gripper element adjacent individual receptacle openings for removably gripping a shaft of a golf club placed in an individual opening, a frame within the cavity and connected to the bag body near the open end, said frame supporting the receptacle structure, said open end and end portion of the receptacle structure each having a locking element which engage and interlock upon placing the receptacle structure into said open end of the bag body, and a liner member extending from the frame lengthwise downward into the cavity, said liner member having a plurality of liner compartments aligned with the openings in the receptacle structure, so that upon placing the shaft of a club into an opening and then into the cavity, the shaft is received in one of said liner compartments.

2. The golf bag of claim 1 where said openings are sized to hold only one golf club.

3. The golf bag of claim 2 where the liner member has individual liner compartments aligned with the receptacle openings, each inner liner compartment sized to hold only one golf club.

4. The golf bag of claim 1 where the receptacle structure has an underside including channels, with the frame being received within the channels upon placing the receptacle structure into said open end of the bag body.

5. The golf bag of claim 1 where there is a connector section near the open end attached to the liner member, said connector section and end portion of the receptacle structure each having said locking elements which engage and interlock upon placing the receptacle structure into said open end of the bag body.

6. The golf bag of claim 1 where the foam material is water proof, having closed cells.

7. The golf bag of claim 6 where the foam material has a density of no more than 12 pounds per cubic feet.

8. A golf bag which holds golf clubs, each club having a shaft and a head, said golf bag including a bag body having a closed end, an open end, and a sidewall between said ends forming an internal cavity which receives the shafts of the golf clubs, a golf club receptacle structure positioned at the open end, said receptacle structure having (i) an end portion which is received within the open end, and (ii) a plurality of openings which extend in a lengthwise direction through said receptacle structure, said receptacle structure having a gripper element adjacent individual receptacle openings for removably gripping a shaft of a golf club placed in an individual opening, a connector section, including an inner wall, near the open end with a frame supporting the receptacle structure, said inner wall of the connector section and said end portion of the receptacle structure each having a locking element which engage and interlock upon placing the receptacle structure into said open end of the bag body, and a liner member attached to the connector section and extending from the frame lengthwise downward into the cavity, said liner member having a plurality of liner compartments aligned with the openings in the receptacle structure, so that upon placing the shaft of a club into an opening and then into the cavity, the shaft is received in one of said liner compartments.

9. The golf bag of claim 8 where said openings are sized to hold only one golf club and said liner member has individual liner compartments aligned with the receptacle opening, each inner liner compartment sized to hold only one golf club.

10. The golf bag of claim 9 where the receptacle structure is made of a foam material.

11. The golf bag of claim 10 where the foam material is water proof, having closed cells.

12. The golf bag of claim 11 where the foam material has a density of no more than 12 pounds per cubic feet.

13. A golf bag which holds golf clubs, each club having a shaft and a head, said golf bag including a bag body having a longitudinal axis, closed end, an open end, and a sidewall between said ends forming an internal cavity which receives the shafts of the golf clubs, a golf club receptacle structure positioned at the open end, said receptacle structure having (i) an end portion which is received within the open end, and (ii) a plurality of openings which extend in a lengthwise direction through said receptacle structure, a frame within the cavity and connected to the bag body near the open end, said frame having at least one component extending across the open end of the bag body which supports the receptacle structure and including a cross-shaped component having a pair of arms which intersect at the longitudinal axis and a circular component having a center which is coincident with the intersection of the arms of the cross-shaped component at the longitudinal axis, said open end and end portion of the receptacle structure each having a locking element which engage and interlock upon placing the receptacle structure into said open end of the bag body, and a liner member extending from the frame lengthwise downward into the cavity, said liner member having a plurality of liner compartments aligned with the openings in the receptacle structure, so that upon placing the shaft of a club into an opening and then into the cavity, the shaft is received in one of said liner compartments.

* * * * *